US012276475B1

(12) United States Patent
Wei

(10) Patent No.: US 12,276,475 B1
(45) Date of Patent: Apr. 15, 2025

(54) TOY GUN AND GAS CYLINDER PIERCING STRUCTURE THEREOF

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 18/382,373

(22) Filed: Oct. 20, 2023

(51) Int. Cl.
*F41B 11/62* (2013.01)
*F41B 11/73* (2013.01)

(52) U.S. Cl.
CPC ..... *F41B 11/62* (2013.01); *F41B 11/73* (2013.01)

(58) Field of Classification Search
CPC ..... F41B 11/60; F41B 11/62; F41B 11/73; F17C 7/00; F17C 13/084
See application file for complete search history.

(56) References Cited

U.S. PATENT DOCUMENTS 9,593,905 B2 * 3/2017 Tseng ..... F41B 11/62
10,151,553 B2 * 12/2018 Yu ..... F41B 11/62
10,228,212 B1 * 3/2019 Wei ..... F41B 11/721
10,352,647 B1 * 7/2019 Wei ..... F41B 11/62
10,393,472 B1 * 8/2019 Wei ..... F41B 11/51
10,724,822 B1 * 7/2020 Chuang ..... F41B 11/62
11,001,435 B2 * 5/2021 Genosar ..... A61M 5/2033
11,041,690 B1 * 6/2021 Wei ..... F41B 11/62
11,187,490 B2 * 11/2021 Tseng ..... F41B 11/724
11,204,218 B1 * 12/2021 Wei ..... F41B 11/89
11,408,514 B2 * 8/2022 Liao ..... F16K 1/523
2014/0290637 A1 * 10/2014 Maeda ..... F41A 17/38 124/74
2017/0299321 A1 * 10/2017 Lort ..... F41B 11/62
2020/0400400 A1 * 12/2020 Tseng ..... F41B 11/62
2021/0389079 A1 * 12/2021 Wei ..... F41B 11/89

* cited by examiner

*Primary Examiner* — Benjamin P Lee
(74) *Attorney, Agent, or Firm* — Chun-Ming Shih; HDLS IPR SERVICES

(57) ABSTRACT

A toy gun and a gas cylinder piercing structure are provided. The gas cylinder piercing structure includes a screw base and a movable push rod unit. The screw base includes a circular through-hole and an annular block around it. A top of the annular block has a slot. The movable push rod unit includes a round push rod movably inserted in the circular through-hole, and a return spring between the screw base and the round push round. A top of the round push rod has a striker pin. The striker pin extends with a needle portion. The striker pin has an engagement lug and a notch. When the engagement lug is blocked by the annular block, the round push rod completely fills the circular through-hole. When the engagement lug is engaged with the slot, the notch and the circular through-hole together form an air vent channel.

19 Claims, 12 Drawing Sheets

TOY GUN AND GAS CYLINDER PIERCING STRUCTURE THEREOF

BACKGROUND OF THE INVENTION

Technical Field

The present disclosure relates to a toy gun and its accessories, and in particular to a toy gun and the gas cylinder piercing structure thereof.

Description of Related Art

Currently, toy guns that use gas cylinders as the power of propulsion for firing bullets utilize a gas cylinder barrel having a compressed gas cylinder inside a gun body. One end of the gas cylinder barrel is provided with a top needle arranged corresponding to a mouth (valve mouth) of the compressed gas cylinder, while the other end is threadedly connected to a screw base that pushes against the compressed gas cylinder. Rotating the screw base may push the compressed gas cylinder to be positioned inside the gun body. At the same time, the top needle pierces the mouth of the compressed gas cylinder, thereby releasing the pressure inside the compressed gas cylinder to provide the power for launching plastic bullets.

However, the above-mentioned method of using the screw base to push the compressed gas cylinder, causing the top need to pierce the mouth of the compressed gas cylinder, has the following disadvantages. Because the screw base needs to be turned multiple times to push the compressed gas cylinder into the gas cylinder barrel. The operation is time-consuming, labor-intensive, and inconvenient for the users. Furthermore, it requires the pressure inside the gas cylinder barrel to balance with the external pressure before the screw base may be unscrewed and detached from the gas cylinder barrel. Therefore, there is a need for improvement.

Accordingly, the inventor of the present disclosure has recognized the shortcomings of the related-art techniques. With a dedicated focus on research and the application of relevant knowledge, the inventor has made every effort to address the aforementioned issues, making them the primary objectives of the improvements pursued in this disclosure.

SUMMARY OF THE INVENTION

The present disclosure provides a toy gun and a gas cylinder piercing structure thereof, which utilizes an air vent channel to release a gas pressure inside a gas cylinder barrel, thereby achieving the advantages of convenient and quick disassembly of the gas cylinder piercing structure.

According to one embodiment of the present disclosure, a gas cylinder piercing structure is provided, including: a screw base including a circular through-hole and an annular block disposed on a periphery of the circular through-hole, a top portion of the annular block being provided with at least one slot; and a movable push rod unit, including a round push rod movably inserted in the circular through-hole and a return spring elastically disposed between the screw base and the round push rod, wherein a top end of the round push rod is provided with a striker pin, the top end of the striker pin extends with a needle portion, and an outer periphery of the striker pin extends with at least one engagement lug and is provided with at least one notch; wherein when the at least one engagement lug is blocked by the annular block, the round push rod completely fills and seals the circular through-hole; when the at least one engagement lug is engaged with the at least one slot, the at least one notch and the circular through-hole are disposed correspondingly to define an air vent channel.

According to one embodiment of the present disclosure, a toy gun for loading at least one gas cylinder is provided. The toy gun includes: a gun body including a gas cylinder barrel and a connecting pipe communicating with one end of the gas cylinder barrel, another end of the gas cylinder barrel being provided with a threaded pipe, the at least one gas cylinder is accommodated in the gas cylinder barrel; and a gas cylinder piercing structure, including: a screw base, one end of the screw base being threadedly connected to the threaded pipe, the screw base including a circular through-hole and an annular block disposed on a periphery of the circular through-hole, a top portion of the annular block being provided with at least one slot; and a movable push rod unit, including a round push rod movably inserted in the circular through-hole and a return spring elastically disposed between the screw base and the round push rod, wherein a top end of the round push rod is provided with a striker pin, the top end of the striker pin extends with a needle portion, and an outer periphery of the striker pin extends with at least one engagement lug and is provided with at least one notch; wherein when the at least one engagement lug is blocked by the annular block, the round push rod completely fills and seals the circular through-hole, and the needle portion punctures the gas cylinder; and when the at least one engagement lug is engaged with the at least one slot, the at least one notch and the circular through-hole are disposed correspondingly to define an air vent channel.

When the gas cylinder piercing structure cannot be detached from the gas cylinder barrel due to high internal pressure, the user may rotate the movable push rod unit, the return spring may drive the round push rod to return to a state where the engagement lug is engaged with the slot. When the engagement lug is engaged with the slot, the notch is arranged corresponding to the circular through-hole to form the air vent channel, allowing the gas pressure inside the gas cylinder barrel to be relieved through the air vent channel. This balances the internal and external pressures of the gas cylinder barrel, facilitating the detachment of the gas cylinder piercing structure, thereby achieving the advantage of convenient and quick disassembly of the gas cylinder piercing structure.

DETAILED DESCRIPTION

Figure 1:
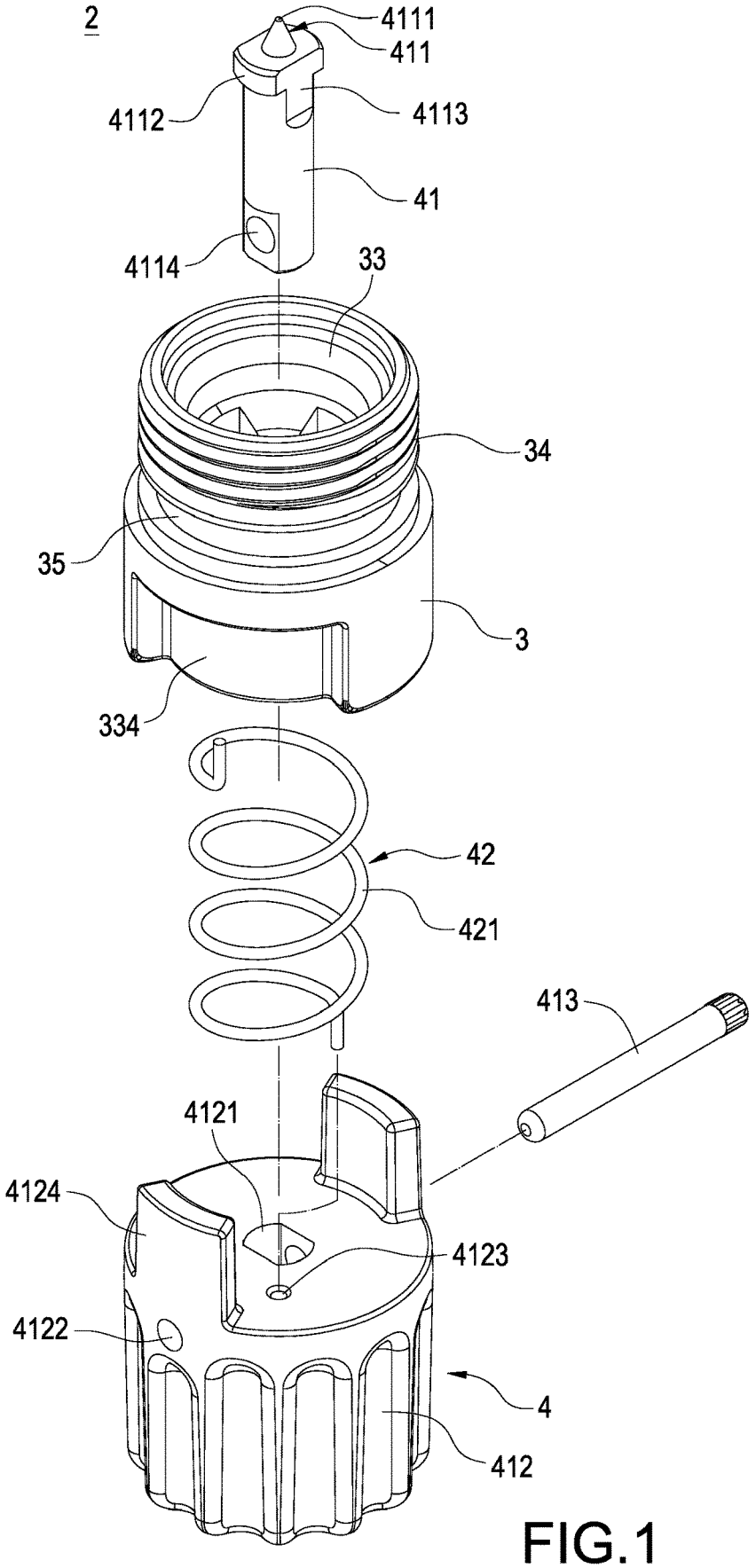
FIG. 1 is a perspective exploded view of a gas cylinder piercing structure of the present disclosure.
Figure 2:
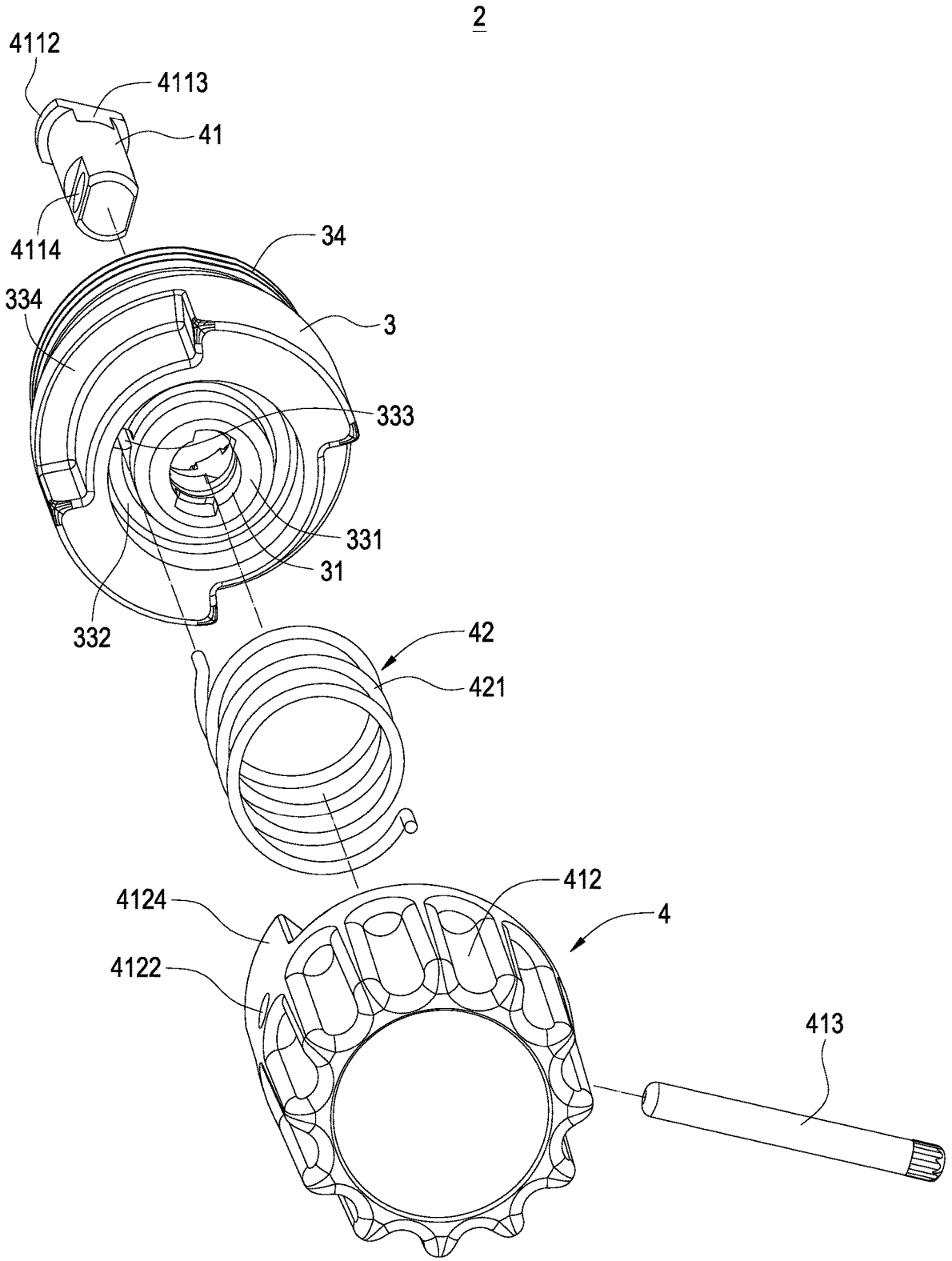
FIG. 2 is another perspective exploded view of the gas cylinder piercing structure of the present disclosure.
Figure 3:
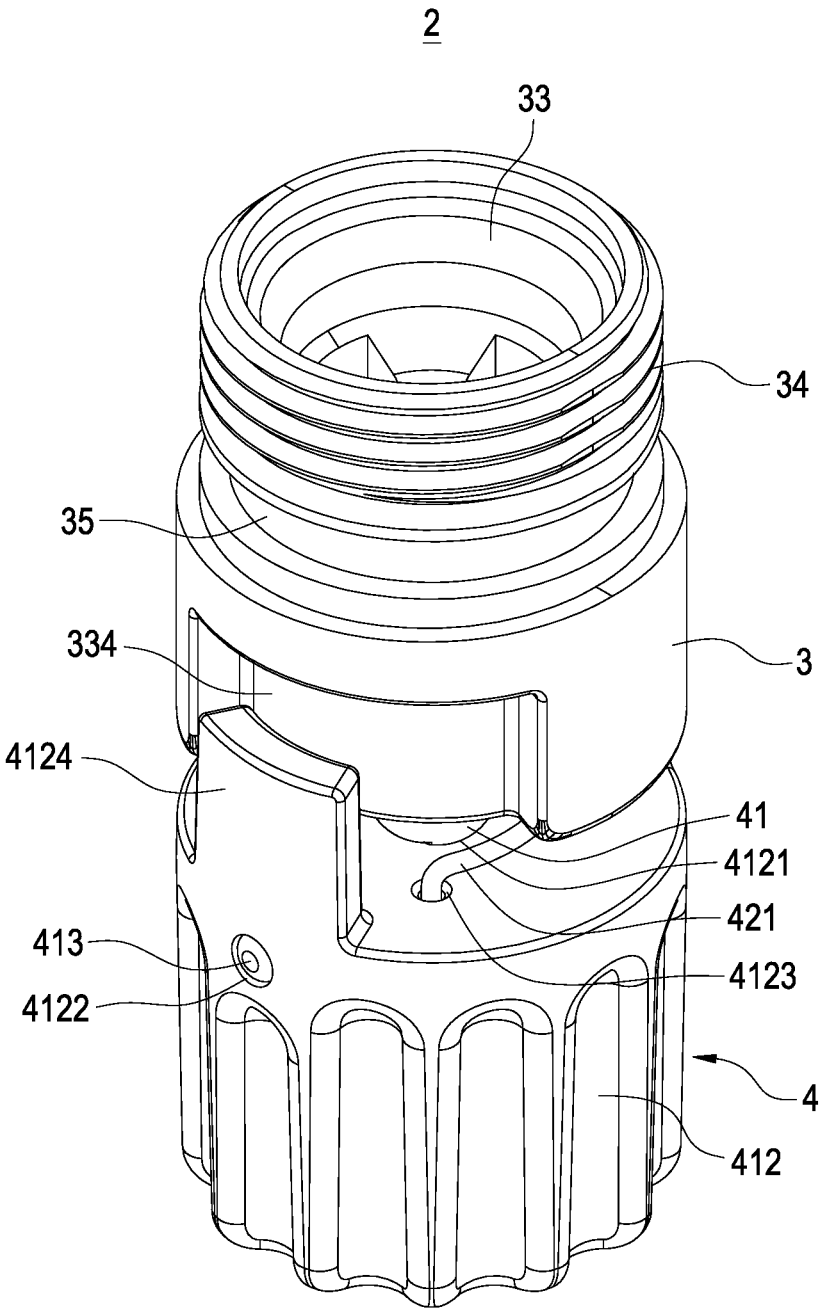
FIG. 3 is a perspective assembled view of the gas cylinder piercing structure of the present disclosure.
Figure 4:
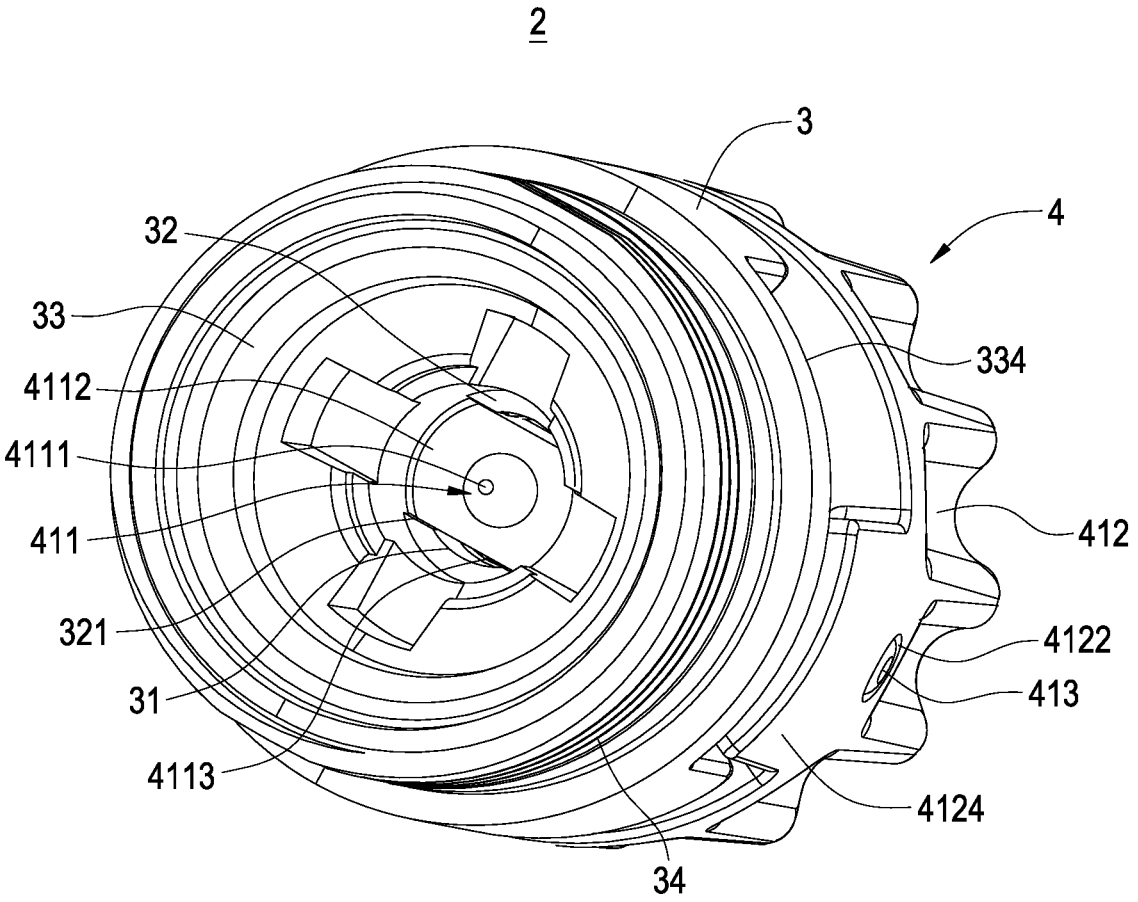
FIG. 4 is a schematic perspective view of the gas cylinder piercing structure in a first usage state of the present disclosure.
Figure 5:
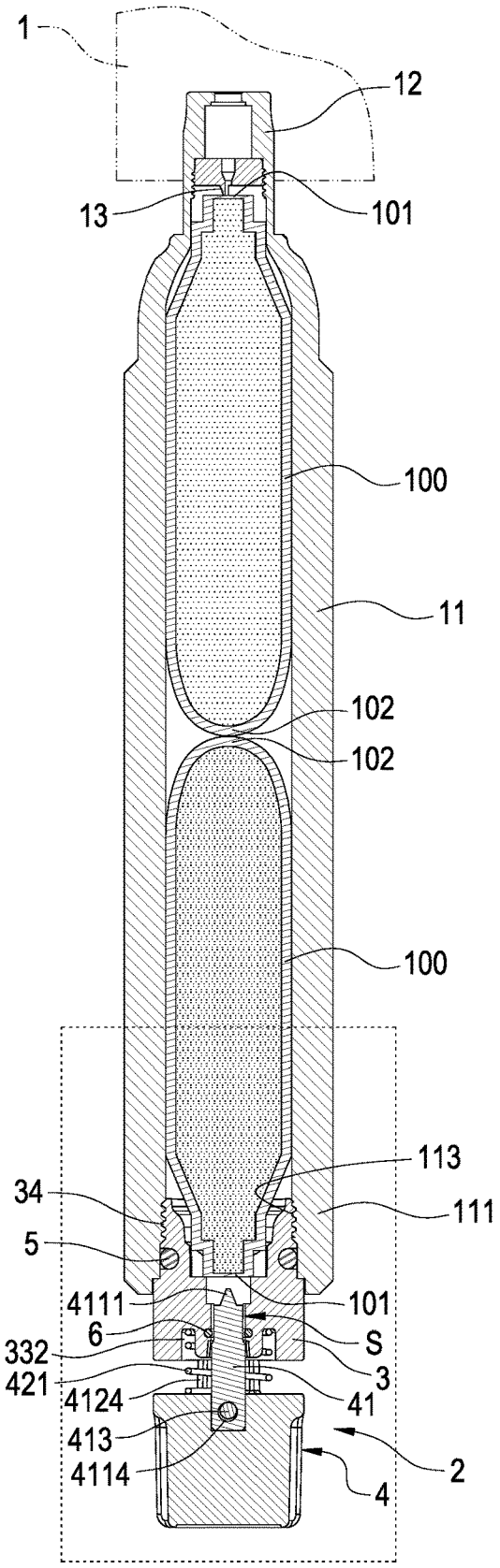
FIG. 5 is a cross-sectional view of a toy gun assembled in the first usage state of the present disclosure.
Figure 6:
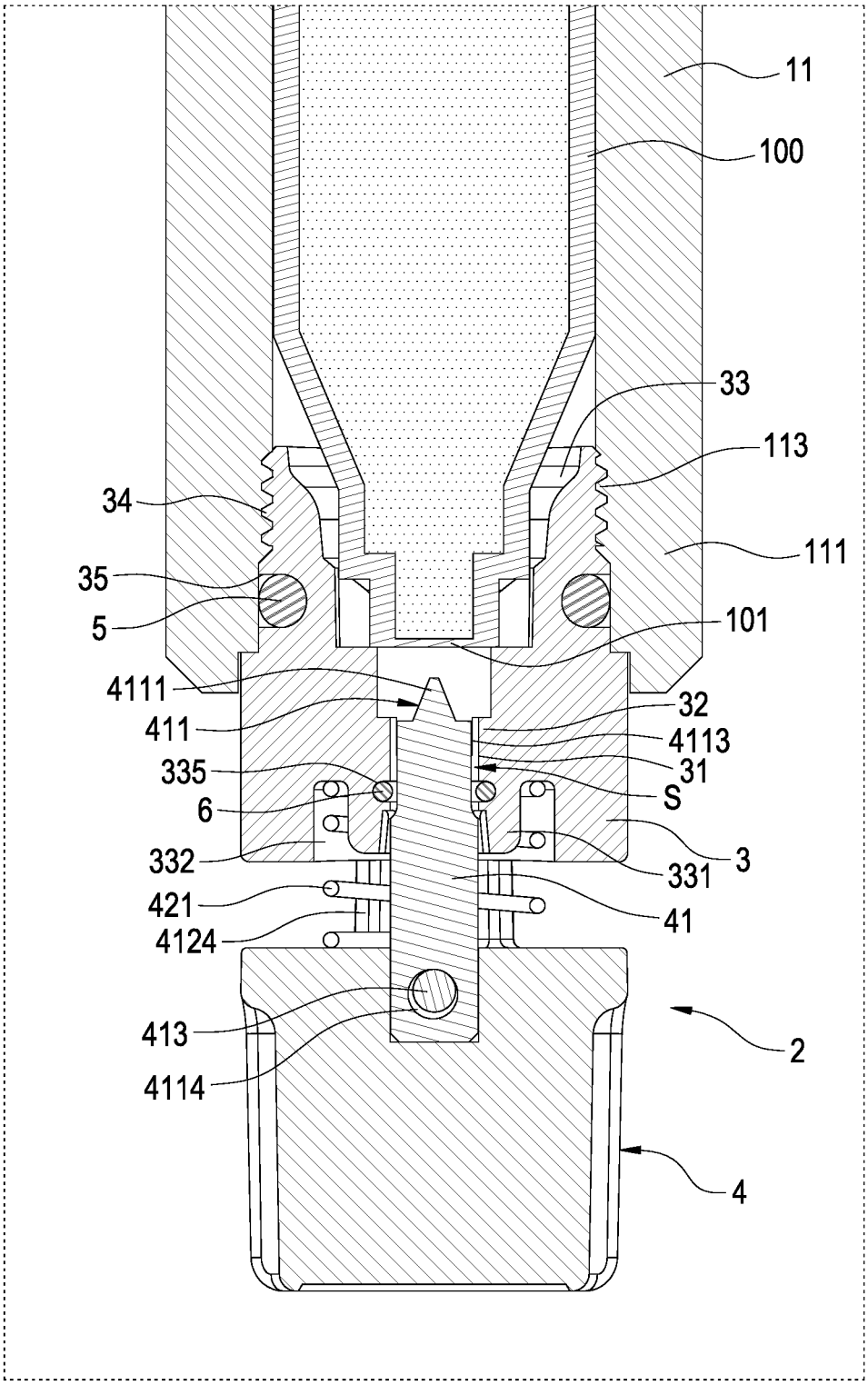
FIG. 6 is a partially enlarged cross-sectional view of the toy gun in the first usage state of the present disclosure.
Figure 7:
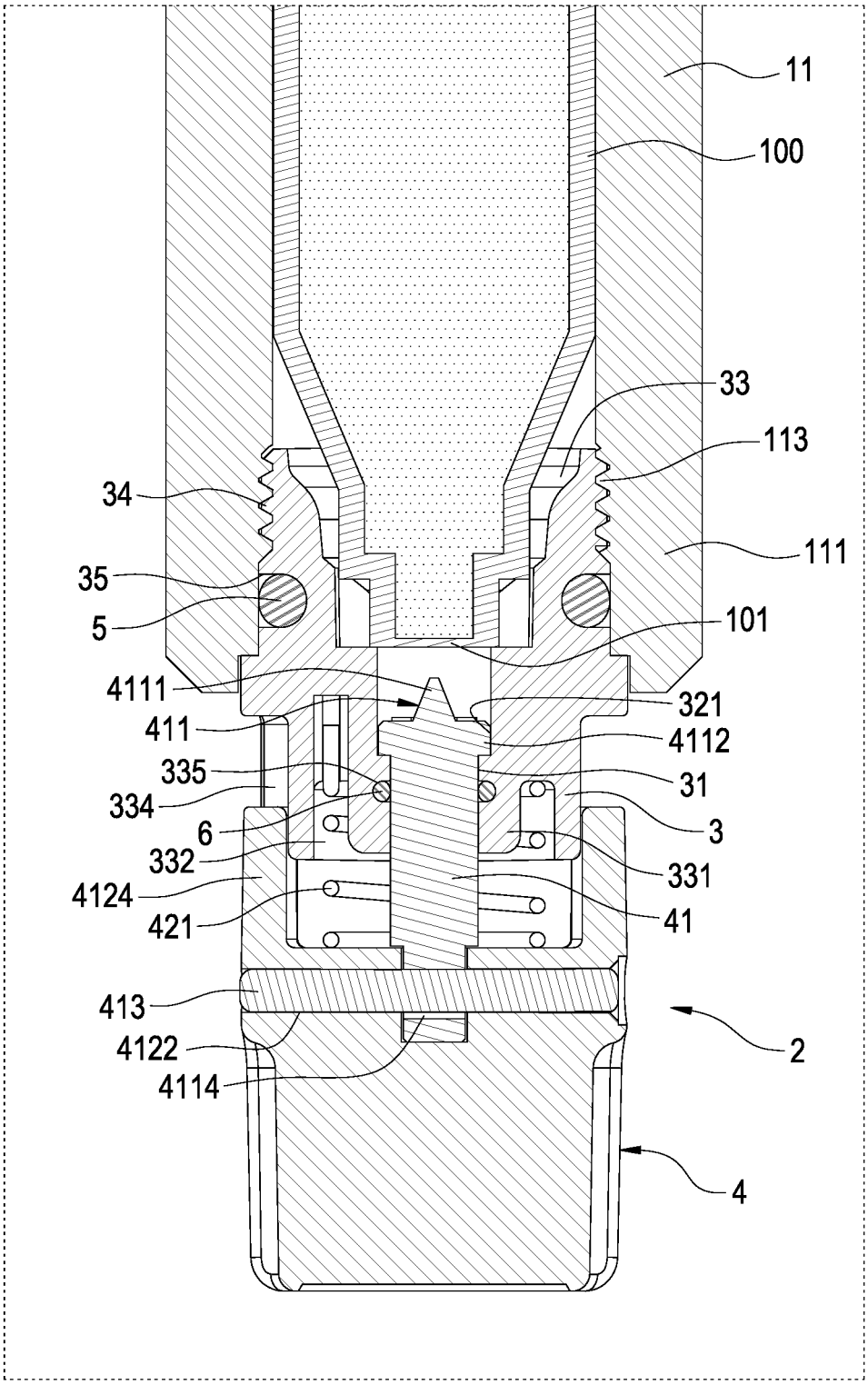
FIG. 7 is another partially enlarged cross-sectional view of the toy gun in the first usage state of the present disclosure.

The details and technical content of the present disclosure, are explained in conjunction with the accompanying drawings. However, the accompanying drawings are for illustrative purposes and are not intended to limit the present disclosure.

Please refer to FIGS. 1 to 12. The present disclosure provides a toy gun and a gas cylinder piercing structure. The toy gun 10 mainly includes a gun body 1 and a gas cylinder piercing structure 2. The gas cylinder piercing structure 2 includes a screw base 3 and a movable push rod unit 4.

As shown in FIGS. 5 to 7, 9, 11 and 12, the toy gun 10 of the present disclosure is used to load two gas cylinders 100. Each gas cylinder 100 includes a mouth 101 at one end and a bottom 102 at the other end. The gas pressure generated after the gas cylinder 100 being punctured is used to provide the firing power for the toy gun 10.

A detailed description is provided as follows. The gun body 1 includes a gas cylinder barrel 11. One end of a gas cylinder barrel 11 is provided with a connecting pipe 12, and the other end of the gas cylinder barrel 11 is provided with a threaded pipe 111. The connecting pipe 12 communicates with a gun barrel (not illustrated in figures) of the gun body 1, and the connecting pipe 12 is used to guide the gas pressure generated by the gas cylinders 100 to flow into the gun barrel for firing bullets (not illustrated in figures). An inner periphery of the threaded pipe 111 is provided with an internal thread 113.

Furthermore, there are two gas cylinders 100 in this embodiment, the present disclosure is not limited in this regard. The two gas cylinders 100 are accommodated inside the gas cylinder barrel 11 and are arranged in an up-down manner. A mouth 101 of one of the gas cylinders 100 is disposed corresponding to the connecting pipe 12. A mouth 101 of the other one of the gas cylinders 100 is disposed corresponding to the threaded pipe 111. The bottoms 102 of the two gas cylinders 100 abuts against each other, and the gun body 1 further includes a piercing needle 13 installed between the gas cylinder 11 and the connecting pipe 12.

As shown in FIGS. 1 to 12, one end of the screw base 3 is threadedly connected to the threaded pipe 111. The screw base 3 is provided with a circular through-hole 31 and an annular block 32 disposed at a periphery of the circular through-hole 31. A top portion of the annular block 32 is provided with one or more slots 321.

As further explained below, the screw base 3 is provided with a concave groove 33 and an external thread 34, and has a bottom wall 331 formed inside the concave groove 33. The external thread 34 is formed on an outer periphery of the screw base 3 and is threadedly connected to the internal thread 113, so that the top end of the screw base 3 is screwed to the threaded pipe 111. The circular through-hole 31 is defined on the bottom wall 331, and the bottom wall 331 forms an annular block 32 on the periphery of the circular through-hole 31.

Furthermore, the inner perimeter size of the concave groove 33 is increased in a stepped manner in the direction away from the bottom wall 331, to facilitate the insertion of the valve mouth 101 of the gas cylinder 100 into the concave groove 33.

Furthermore, a side of the bottom wall 331 away from the concave groove 33 is provided with an annular groove 332. An inner wall of the annular groove 332 is provided with a first insertion hole 333. The outer periphery of the screw base 3 is provided with two limiting recesses 334. A first annular recess 35 is located between the limiting recesses 334 and the external thread 34. An inner periphery of the circular through-hole 31 is provided with a second annular recess 335.

As shown in FIGS. 1 to 12, the movable push rod unit 4 includes a round push rod 41 movably inserted in the circular through-hole 31 and a return spring 42 elastically supporting between the screw base 3 and the round push rod 41. A top end of the round push rod 41 is provided with a striker pin 411. A top end of the striker pin 411 extends with a needle portion 4111. An outer periphery of the striker pin 411 extends with one or more engagement lugs 4112 and is provided with one or more notches 4113.

In this embodiment, there are two slots 321, two engagement lugs 4112, and two notches 4113, the present disclosure is not limited in this regard. The two engagement lugs 4112 extend from the outer periphery of the striker pin 411 on its front and rear sides, and two notches are defined on left and right sides of the outer periphery of the striker pin 411.

Additionally, the movable push rod unit 4 includes a rotatable press block 412 and a latch 413. The rotatable press block 412 has a first fixing hole 4121 and a second fixing hole 4122 communicating with each other. The round push rod 41 has a third fixing hole 4114. The round push rod 41 is inserted in the first fixing hole 4121, and the latch 413 passes through the second fixing hole 4122 and the third fixing hole 4114 to make the round push rod 41 be firmly fixed to the rotatable press block 412 and rotate with the rotatable press block 412.

Furthermore, the rotatable press block 412 is provided with a second insertion hole 4123. The return spring 42 is a coil spring 421 placed in the annular groove 332. One end of the coil spring 421 is inserted into the first insertion hole 333, and the other end of the coil spring 421 is inserted into the second insertion hole 4123. The coil spring 421 is used to drive the round push rod 41 to return to the state where the engagement lugs 4112 are engaged with the slots 321.

Moreover, the rotatable press block 412 extends with two protruding blocks 4124. Each protruding block 4124 is fitted and slidable in each of the limiting recesses 334, thereby restricting a rotation angle of the rotatable press block 412.

As shown in FIGS. 5 to 7, 9, 11 and 12, the toy gun 10 of the present disclosure includes a first sealing ring 5 and a second sealing ring 6. The first sealing ring 5 is accommodated in the first annular recess 35 and is clamped between the threaded pipe 111 and the screw base 3. The first sealing ring 5 is used to provide an airtight effect between the threaded pipe 111 and the screw base 3. The second sealing ring 6 is accommodated in the second annular recess 335 and may be clamped between the round push rod 41 and the screw base 3. The second sealing ring 6 is used to provide an airtight effect between the round push rod 41 and the screw base 3.

When the engagement lugs 4112 are blocked by the annular block 32, the round push rod 41 completely fills and seals the circular through-hole 31. The round push rod 41 may first drive the needle portion 4111 to pierce the mouth 101 of one of the gas cylinders 100, and then push the other gas cylinder 100 closer to the piercing needle 13 for the mouth 101 to be pierced, allowing the gas pressure generated after piercing the gas cylinder 100 to flow into the gun barrel through the connecting pipe 12 to fire bullets.

Furthermore, when the engagement lugs 4112 are engaged with the slots 321, the notches 4113 are disposed corresponding to the circular through-hole 31, forming an air vent channel S. This allows the gas pressure inside the gas cylinder barrel 11 and the threaded pipe 111 to be vented through the air vent channel S, balancing the internal and external pressures of the gas cylinder barrel 11 and the threaded pipe 111. This facilitates loosening the threaded connection between the external thread 34 and the internal thread 113, allowing the gas cylinder piercing structure 2 to be detached from the threaded pipe 111.

FIGS. 4 to 7 illustrate a first usage state of the toy gun 10 according to the present disclosure. When no force is applied to the rotatable press block 412, the coil spring 421 drives the round push rod 41 to return to the state where the engagement lugs 4112 are engaged with the slots 321. At this time, the needle portion 4111 is away from the gas cylinder 100, and the notches 4113 are disposed corresponding to the circular through-hole 31, forming the air vent channel S.

Figure 8:
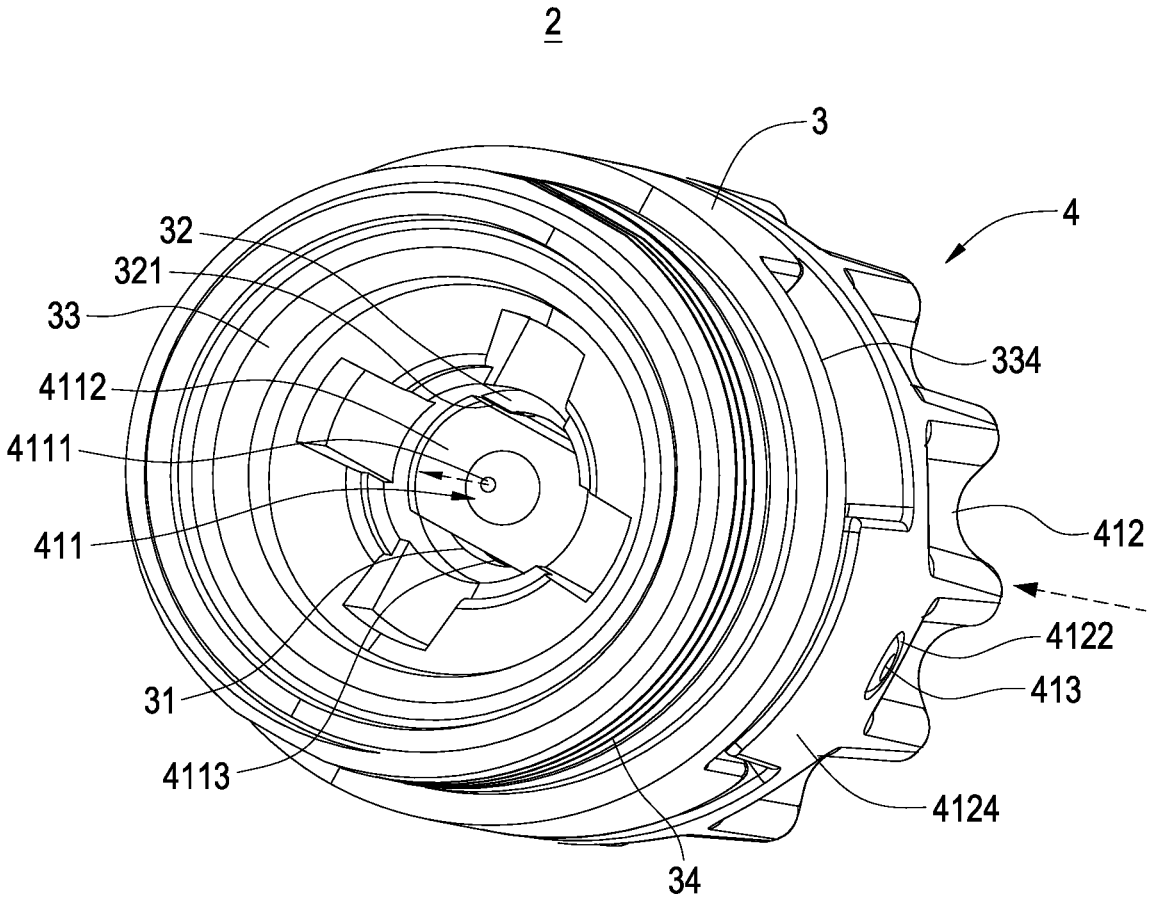
FIG. 8 is a schematic perspective view of the gas cylinder piercing structure in a second usage state of the present disclosure.
Figure 9:
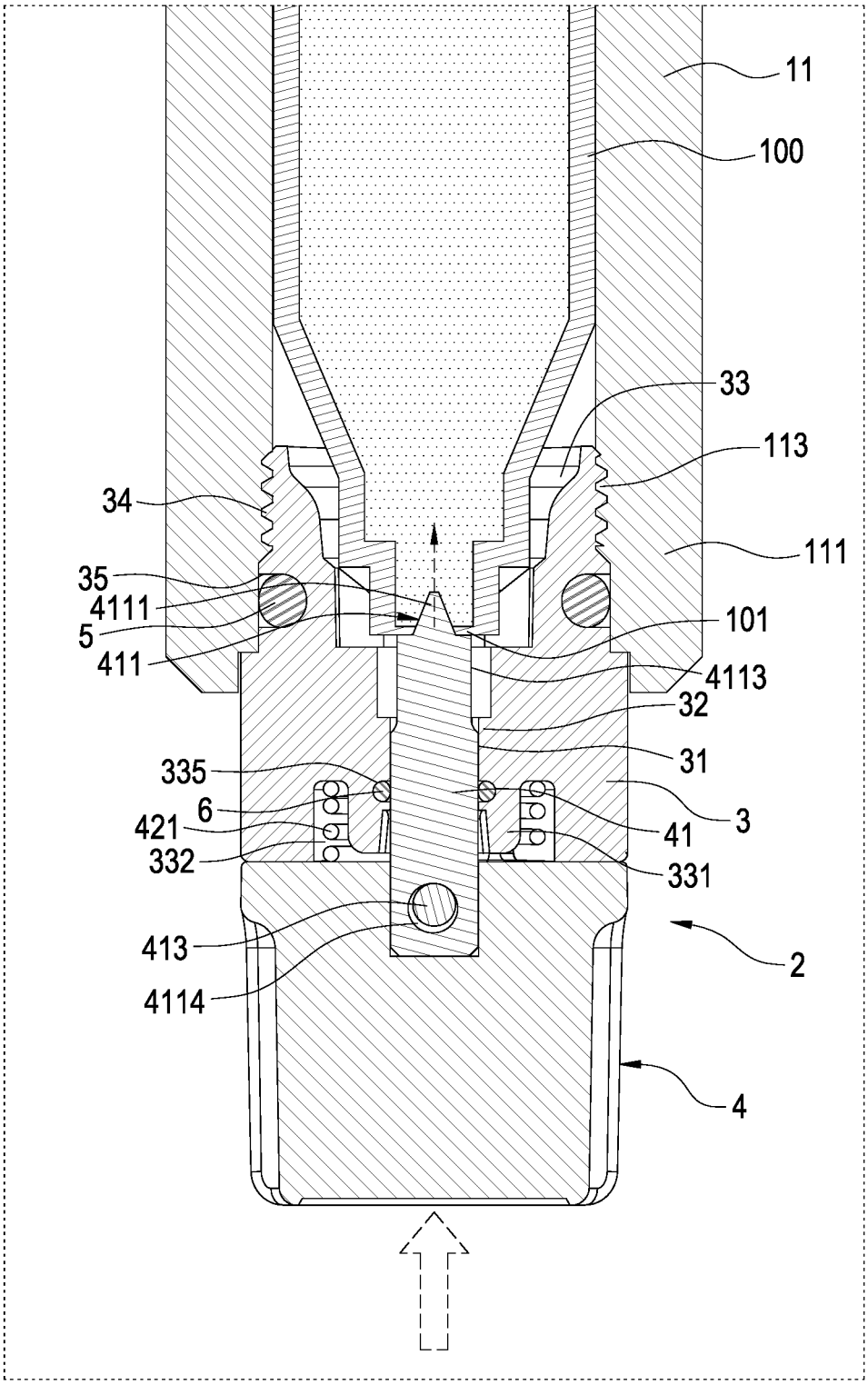
FIG. 9 is a partially enlarged cross-sectional view of the toy gun in the second usage state of the present disclosure.

As shown in FIGS. 8 and 9, in a second usage state of the toy gun 10 according to the present disclosure, when the user presses the rotatable press block 412, the rotatable press block 412 resists a tensile force of the coil spring 421. This causes the rotatable press block 412 to first drive the needle portion 4111 of the round push rod 41 to pierce one of the gas cylinders 100, and then push the other gas cylinder 100 closer to the piercing needle 13 for the mouth 101 to be pierced.

Figure 10:
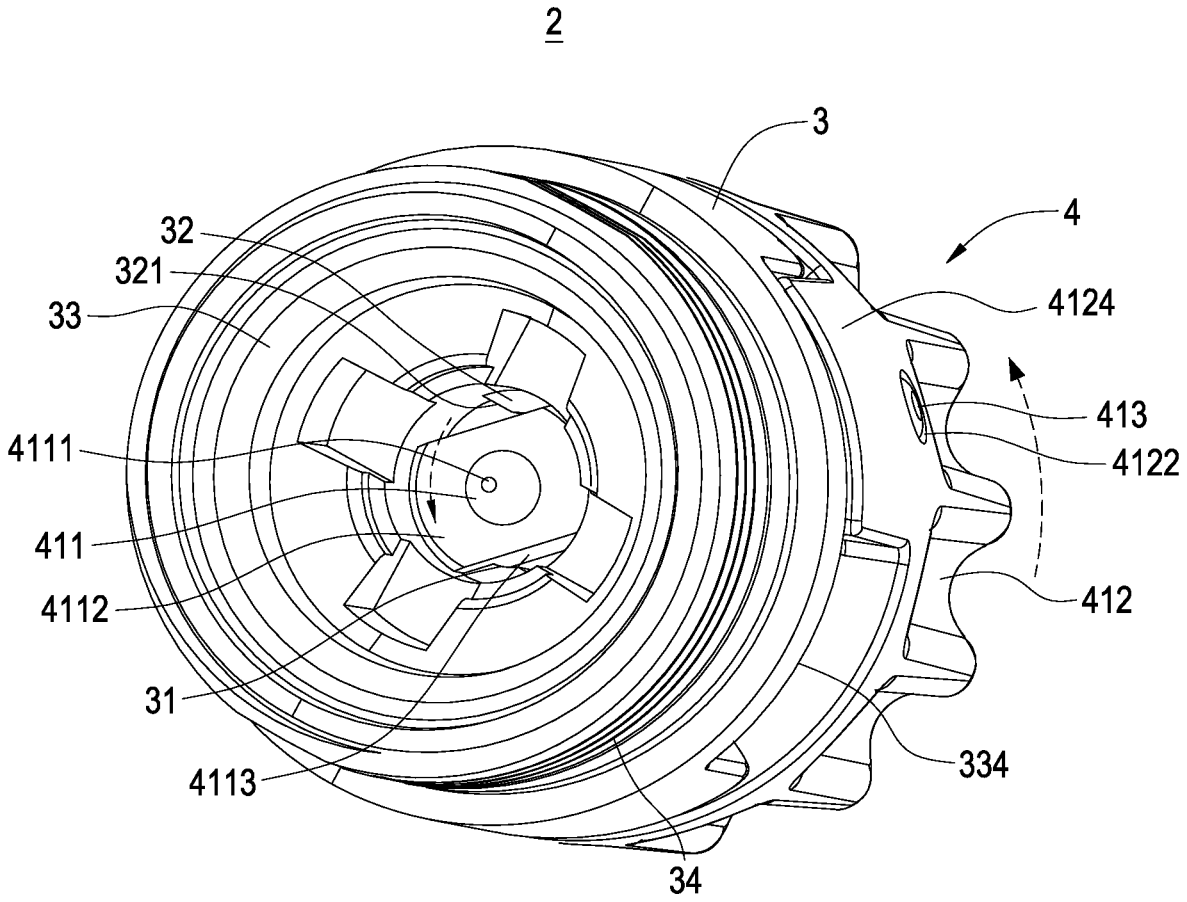
FIG. 10 is a schematic perspective view of the gas cylinder piercing structure in a third usage state of the present disclosure.
Figure 11:
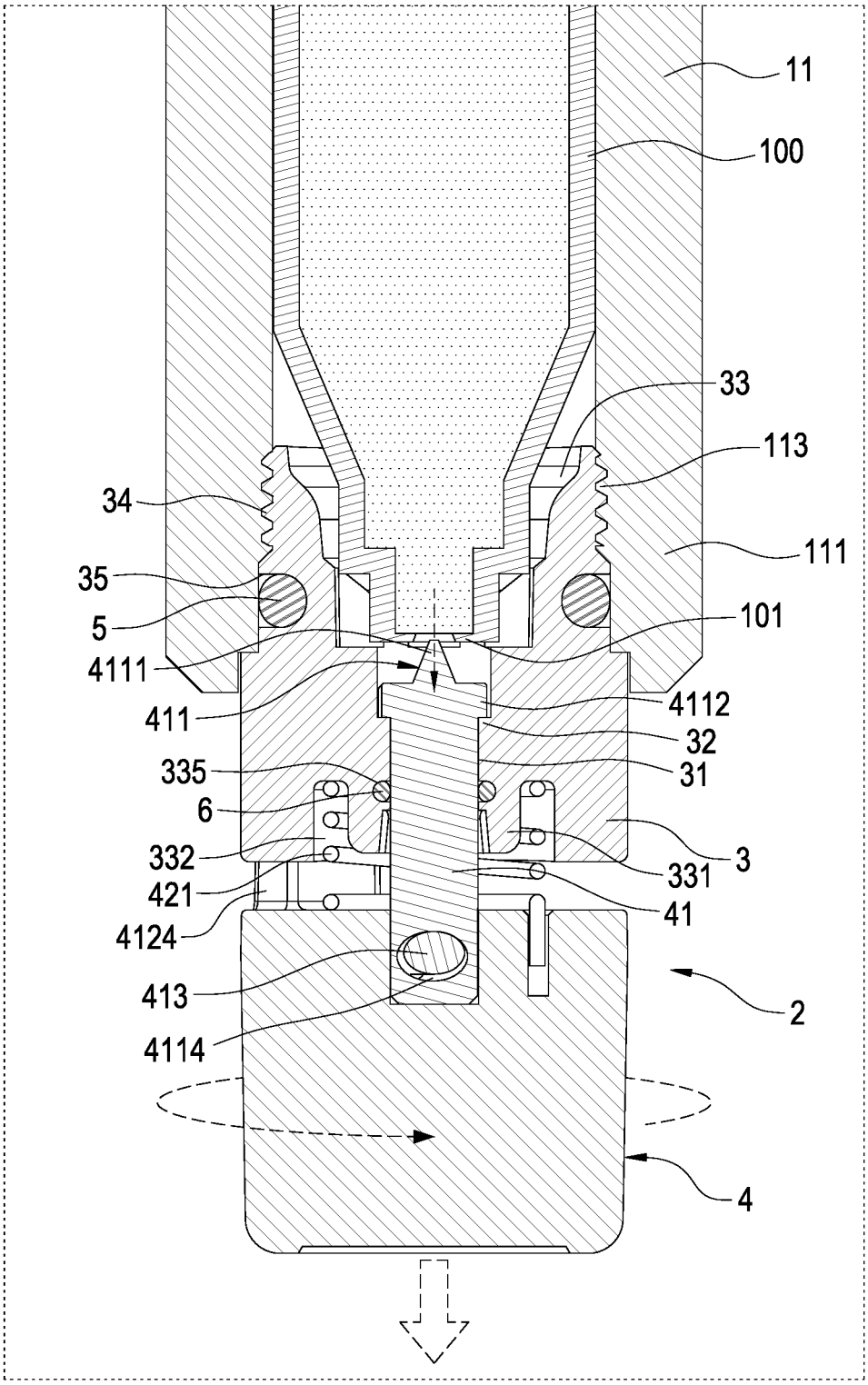
FIG. 11 is a partially enlarged cross-sectional view of the toy gun in the third usage state of the present disclosure.

FIGS. 10 and 11 show a third usage state of the toy gun 10. After the rotatable press block 412 is rotated and released by the user, the rotatable press block 412 resists the torque of the coil spring 421, causing the engagement lug 4112 to be stopped by the annular block 32. At this point, the round push rod 41 completely fills and seals the circular through-hole 31, allowing the gas pressure generated after puncturing the gas cylinders 100 to flow into the gun barrel through the connecting pipe 12 to fire the bullet, achieving the effect of puncturing the gas cylinders 100 in two stages.

Figure 12:
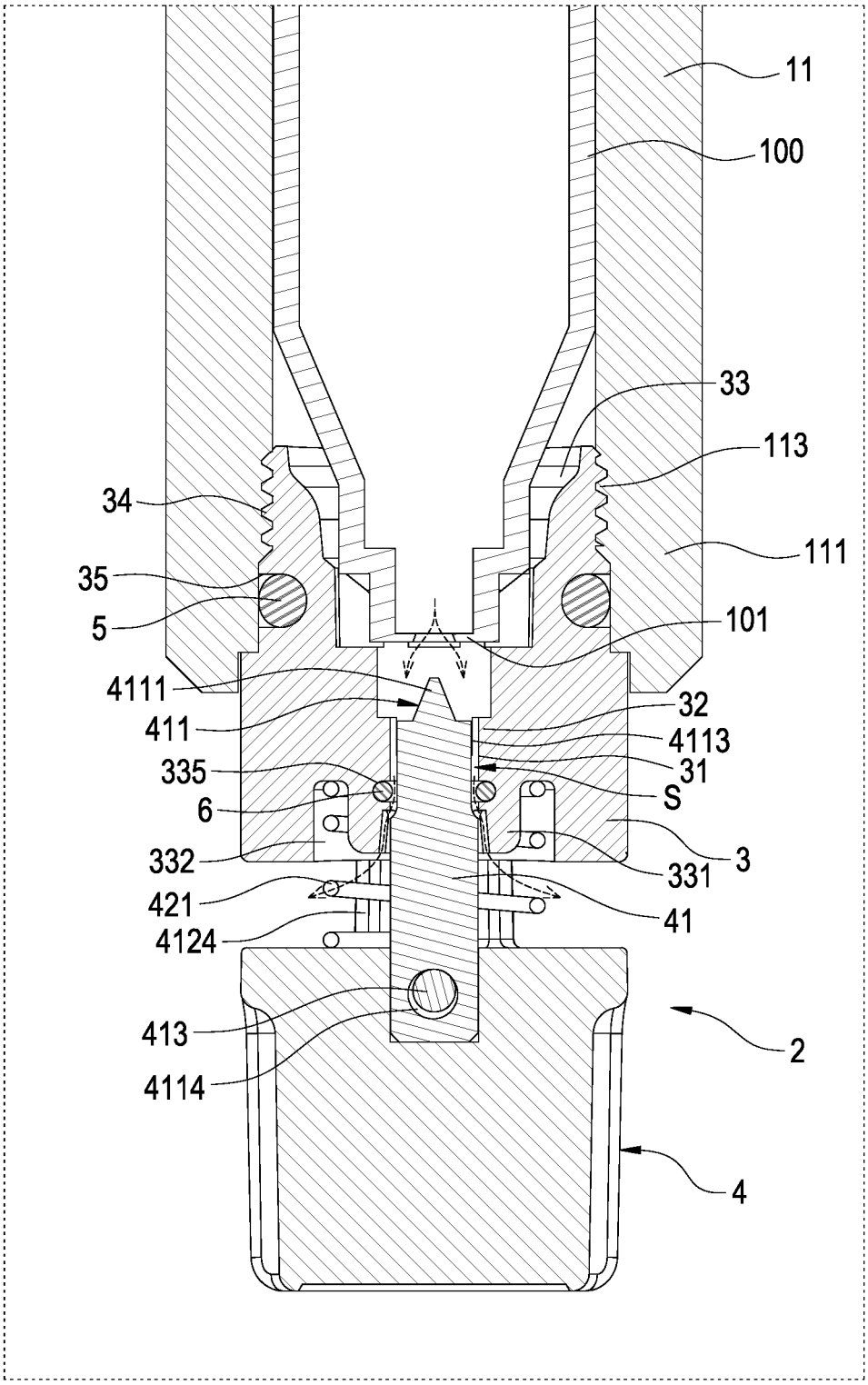
FIG. 12 is a partial enlarged cross-sectional view of the toy gun in a fourth usage state of the present disclosure.

As shown in FIG. 12, in a fourth usage state of the toy gun 10, when the threaded pipe 111 cannot loosen the external thread 34 from the internal thread 113 due to high internal pressure, the user may rotate the rotatable press block 412 again. This causes the coil spring 421 to drive the round push rod 41 to return to the state where the engagement lug 4112 is engaged with the slot 321. When the engagement lug 4112 is engaged with the slot 321, the notch 4113 is arranged corresponding to the circular through-hole 31 to form the air vent channel S, allowing the gas pressure inside the gas cylinder barrel 11 and the threaded pipe 111 to be relieved through the air vent channel S. This balances the internal and external pressures of the gas cylinder barrel 11 and the threaded pipe 111, facilitating the loosening of the external thread 34 from the internal thread 113, thereby achieving the advantage of convenient and quick disassembly of the gas cylinder piercing structure 2.

In summary, the toy gun and the gas cylinder piercing structure thereof in the present disclosure may indeed achieve the expected purposes, address the shortcomings of related-art techniques.

What is claimed is:

1. A gas cylinder piercing structure, comprising:

a screw base, comprising a circular through-hole, an annular block disposed on a periphery of the circular through-hole, and at least one slot defined on a top portion of the annular block; and a movable push rod unit, comprising a round push rod movably inserted in the circular through-hole and a return spring elastically disposed between the screw base and the round push rod, wherein the round push rod comprises a striker pin disposed on a top end thereof, and the striker pin comprises a needle portion extending from a top end thereof, at least one engagement lug extending from an outer periphery thereof, and at least one notch defined on the outer periphery thereof;

wherein when the at least one engagement lug is blocked by the annular block, the round push rod completely fills and seals the circular through-hole;

when the at least one engagement lug is engaged with the at least one slot, the at least one notch and the circular through-hole are disposed correspondingly to define an air vent channel.

2. The gas cylinder piercing structure as claimed in claim 1, wherein an amount of the slot, an amount of the engagement lug, and an amount of the notch are two, respectively, the two engagement lugs extend from front side and rear side of the outer periphery of the striker pin, and the two notches are defined on left side and right side of the outer periphery of the striker pin.

3. The gas cylinder piercing structure as claimed in claim 1, wherein the screw base comprises a concave groove, an external thread, and a bottom wall arranged inside the concave groove, the external thread is arranged on an outer periphery of the screw base, the circular through-hole is defined on the bottom wall, and the annular block is disposed on the bottom wall and forms around the periphery of the circular through-hole.

4. The gas cylinder piercing structure as claimed in claim 3, wherein an inner perimeter size of the concave groove is steppedly increased in a direction away from the bottom wall.

5. The gas cylinder piercing structure as claimed in claim 3, wherein the movable push rod unit further comprises a rotatable press block and a latch, the rotatable press block comprises a first fixing hole and a second fixing hole communicating with each other, the round push rod comprises a third fixing hole, the round push rod is inserted in the first fixing hole, and the latch passes through the second fixing hole and the third fixing hole.

6. The gas cylinder piercing structure as claimed in claim 5, wherein an annular groove is defined on one side of the bottom wall away from the concave groove, a first insertion hole is defined on an inner wall of the annular groove, the rotatable press block comprises a second insertion hole, the return spring is a coil spring accommodated in the annular groove, one end of the coil spring is inserted in the first insertion hole, and another end of the coil spring is inserted in the second insertion hole.

7. The gas cylinder piercing structure as claimed in claim 6, wherein the screw base comprises two limiting recesses defined on the outer periphery thereof, the rotatable press block comprises two protruding blocks extending therefrom, and each of the protruding blocks is fitted and slidable in each of the limiting recesses.

8. The gas cylinder piercing structure as claimed in claim 7, further comprising a first sealing ring, wherein a first annular recess is defined on the outer periphery of the screw base and located between the two limiting recesses and the external thread, and the first sealing ring is accommodated in the first annular recess.

9. The gas cylinder piercing structure as claimed in claim 1, further comprising a second sealing ring, wherein a second annular recess is defined on an inner periphery of the circular through-hole, and the second sealing ring is accommodated in the second annular recess and is sandwiched between the round push rod and the screw base.

10. A toy gun for loading at least one gas cylinder, the toy gun comprising:

a gun body, comprising a gas cylinder barrel, a connecting pipe communicating with one end of the gas cylinder barrel, and a threaded pipe disposed on another end of the gas cylinder barrel, the at least one gas cylinder is accommodated in the gas cylinder barrel; and a gas cylinder piercing structure, comprising:

a screw base, one end thereof threadedly connected to the threaded pipe, comprising a circular through-hole, an annular block disposed on a periphery of the circular through-hole, and at least one slot defined on a top portion of the annular block; and a movable push rod unit, comprising a round push rod movably inserted in the circular through-hole and a return spring elastically disposed between the screw base and the round push rod, wherein the round push rod comprises a striker pin disposed on a top end thereof, and the striker pin comprises a needle portion extending from a top end thereof, at least one engagement lug extending from an outer periphery thereof, and at least one notch defined on the outer periphery thereof;

wherein when the at least one engagement lug is blocked by the annular block, the round push rod completely fills and seals the circular through-hole, and the needle portion punctures the gas cylinder; and when the at least one engagement lug is engaged with the at least one slot, the at least one notch and the circular through-hole are disposed correspondingly to define an air vent channel.

11. The toy gun as claimed in claim 10, wherein an amount of the slot, an amount of the engagement lug, and an amount of the notch are two, respectively, the two engagement lugs extend from front side and rear side of the outer periphery of the striker pin, and the two notches are defined on left side and right side of the outer periphery of the striker pin.

12. The toy gun as claimed in claim 10, wherein the threaded pipe comprises an internal thread disposed on an inner periphery thereof, the screw base comprises a concave groove, an external thread, and a bottom wall arranged inside the concave groove, the external thread is arranged on an outer periphery of the screw base and is threadedly connected with the internal thread, the circular through-hole is defined on the bottom wall, and the annular block is disposed on the bottom wall around the periphery of the circular through-hole.

13. The toy gun as claimed in claim 12, wherein an inner perimeter size of the concave groove is steppedly increased in a direction away from the bottom wall.

14. The toy gun as claimed in claim 12, wherein the movable push rod unit further comprises a rotatable press block and a latch, the rotatable press block comprises a first fixing hole and a second fixing hole communicating with each other, the round push rod comprises a third fixing hole, the round push rod is inserted in the first fixing hole, and the latch passes through the second fixing hole and the third fixing hole.

15. The toy gun as claimed in claim 14, wherein an amount of the gas cylinder is two, the two gas cylinders are accommodated in the gas cylinder barrel in an up-down manner, and the gun body further comprises a piercing needle installed between the gas cylinder barrel and the connecting pipe, when the rotatable press block is pressed, the rotatable press block drives the needle portion of the round push rod to puncture one of the gas cylinders, and then pushes another one of the gas cylinders to approach and be punctured by the piercing needle.

16. The toy gun as claimed in claim 14, wherein an annular groove is defined on one side of the bottom wall away from the concave groove, a first insertion hole is defined on an inner wall of the annular groove, the rotatable press block comprises a second insertion hole, the return spring is a coil spring accommodated in the annular groove, one end of the coil spring is inserted in the first insertion hole, and another end of the coil spring is inserted in the second insertion hole.

17. The toy gun as claimed in claim 16, wherein the screw base comprises two limiting recesses defined on the outer periphery thereof, the rotatable press block comprises two protruding blocks extending therefrom, and each of the protruding blocks is fitted and slidable in each of the limiting recesses.

18. The toy gun as claimed in claim 17, further comprising a first sealing ring, wherein a first annular recess is defined on the outer periphery of the screw base and located between the two limiting recesses and the external thread, and the first sealing ring is accommodated in the first annular recess and sandwiched between the threaded pipe and the screw base.

19. The toy gun as claimed in claim 10, further comprising a second sealing ring, wherein a second annular recess is defined on an inner periphery of the circular through-hole, and the second sealing ring is accommodated in the second annular recess and is sandwiched between the round push rod and the screw base.

* * * * *